US010100827B2

(12) United States Patent
Devan et al.

(10) Patent No.: US 10,100,827 B2
(45) Date of Patent: Oct. 16, 2018

(54) ELECTRONIC CONTROL FOR A ROTARY FLUID DEVICE

(75) Inventors: Stephen Marshall Devan, Madison, MS (US); Phillip W. Galloway, Madison, MS (US); Kevin Stuart Williams, Madison, MS (US)

(73) Assignee: Eaton Intelligent Power Limited (IE)

( * ) Notice: Subject to any disclaimer, the term of this patent is extended or adjusted under 35 U.S.C. 154(b) by 1904 days.

(21) Appl. No.: 12/181,083

(22) Filed: Jul. 28, 2008

(65) Prior Publication Data

US 2010/0021313 A1 Jan. 28, 2010

(51) Int. Cl.

| | |
|---|---|
| ***F04B 49/10*** | (2006.01) |
| ***F04B 1/30*** | (2006.01) |
| ***F04B 49/20*** | (2006.01) |
| ***F04B 49/06*** | (2006.01) |
| ***F04B 17/03*** | (2006.01) |

(52) U.S. Cl.

CPC ..... *F04B 49/103* (2013.01); *F04B 1/30* (2013.01); *F04B 17/03* (2013.01); *F04B 49/065* (2013.01); *F04B 49/20* (2013.01); *F04B 49/106* (2013.01); *F04B 2203/0201* (2013.01); *F04B 2203/0202* (2013.01); *F04B 2203/0209* (2013.01)

(58) Field of Classification Search

CPC ..... F04B 49/06–49/065; F04B 17/03; F04B 1/20–1/2092; F04B 27/14–27/24; F04B 35/04; F04D 15/0066; F04D 15/0077; F04D 15/0088; F04D 15/0094; F04D 15/0245–15/0281; F04D 13/06–13/064; F04D 13/0666–13/0693

USPC ..... 417/22, 32, 44.1–45, 53, 44.11, 42, 459, 417/13, 18

See application file for complete search history.

(56) References Cited

U.S. PATENT DOCUMENTS

| | | | |
|---|---|---|---|
| 3,130,902 | A | 4/1964 | Brown |
| 4,485,623 | A | 12/1984 | Chichester et al. |
| 4,604,036 | A | 8/1986 | Sutou et al. |
| 4,794,310 | A | 12/1988 | Lukas et al. |
| 4,841,404 | A | 6/1989 | Marshall et al. |
| 5,181,837 | A | 1/1993 | Niemiec |

(Continued)

FOREIGN PATENT DOCUMENTS

| | | |
|---|---|---|
| EP | 1 585 205 | 10/2005 |
| EP | 1 897 439 | 3/2008 |

(Continued)

OTHER PUBLICATIONS

Invitation to Pay Additional Fees and Partial International Search Report dated Jul. 5, 2010.

(Continued)

*Primary Examiner* — Alexander Comley
(74) *Attorney, Agent, or Firm* — Merchant & Gould P.C.

(57) ABSTRACT

A fluid device system includes a fluid pump, an electric motor in engagement with the fluid pump, and a controller. The electric motor is adapted for rotation in response to an electric signal. The controller is adapted to communicate the electric signal to the electric motor. The controller includes a lookup table having a plurality of performance data related to the fluid pump and the electric motor. The performance data from the lookup table is used by the controller to set aspects of the electrical signal communicated to the electric motor in order to achieve a desired attribute of the fluid pump.

9 Claims, 5 Drawing Sheets

(56) References Cited

U.S. PATENT DOCUMENTS

| | | | | |
|---|---|---|---|---|
| 5,216,606 | A * | 6/1993 | Lentz et al. | 701/66 |
| 5,354,182 | A | 10/1994 | Niemiec et al. | |
| 5,360,322 | A | 11/1994 | Henein et al. | |
| 5,489,831 | A | 2/1996 | Harris | |
| 5,580,221 | A | 12/1996 | Triezenberg | |
| 5,664,937 | A | 9/1997 | Takahashi et al. | |
| 5,677,605 | A | 10/1997 | Cambier et al. | |
| 5,778,671 | A | 7/1998 | Bloomquist et al. | |
| 5,865,602 | A | 2/1999 | Nozari | |
| 5,905,648 | A * | 5/1999 | Badami | 700/55 |
| 6,045,331 | A | 4/2000 | Gehm et al. | |
| 6,176,086 | B1 | 1/2001 | Betz | |
| 6,200,101 | B1 * | 3/2001 | North, Jr. | 417/36 |
| 6,226,582 | B1 | 5/2001 | Adsett et al. | |
| 6,264,432 | B1 * | 7/2001 | Kilayko et al. | 417/44.1 |
| 6,315,369 | B1 | 11/2001 | Hirose | |
| 6,484,696 | B2 * | 11/2002 | Barnes et al. | 123/446 |
| 6,592,336 | B1 | 7/2003 | Hirano et al. | |
| 6,663,349 | B1 * | 12/2003 | Discenzo et al. | 417/44.1 |
| 6,941,785 | B2 * | 9/2005 | Haynes | F04B 17/03 318/799 |
| 6,949,908 | B2 | 9/2005 | Maslov et al. | |
| 6,979,181 | B1 * | 12/2005 | Kidd | 318/400.08 |
| 7,081,728 | B2 * | 7/2006 | Kemp | 318/437 |
| 7,096,772 | B2 * | 8/2006 | Sporer et al. | 91/419 |
| 7,176,648 | B2 * | 2/2007 | Choi | 318/625 |
| 2002/0096219 | A1 | 7/2002 | Frasure et al. | |
| 2003/0206805 | A1 * | 11/2003 | Bishop et al. | 417/44.2 |
| 2004/0124796 | A1 * | 7/2004 | Bailey et al. | 318/254 |
| 2004/0145330 | A1 * | 7/2004 | Maslov et al. | 318/437 |
| 2006/0042240 | A1 * | 3/2006 | Sporer et al. | 60/329 |
| 2007/0154321 | A1 * | 7/2007 | Stiles et al. | 417/44.1 |
| 2009/0087319 | A1 * | 4/2009 | Russold | F04B 49/065 417/45 |
| 2010/0072760 | A1 | 3/2010 | Anderson | |

FOREIGN PATENT DOCUMENTS

| | | |
|---|---|---|
| KR | 2002/0076788 | 10/2002 |
| WO | WO 2007/071520 | 6/2007 |

OTHER PUBLICATIONS

International Search Report and Written Opinion dated Oct. 1, 2010.
European Search Report dated Apr. 12, 2012, 6 pages.

* cited by examiner

ELECTRONIC CONTROL FOR A ROTARY FLUID DEVICE

BACKGROUND

Hydraulic systems having hydraulic pumps, such as axial piston pumps, typically rely on mechanical pressure compensation devices to control torque and/or horsepower output from the hydraulic pump. Mechanical pressure compensation devices include yokes, springs, and mechanical valves disposed in the hydraulic system. While such devices are effective for the purpose of controlling torque or horsepower output of the hydraulic pump, such devices add complexity, cost and weight to hydraulic systems. In some applications, the complexity, cost and weight of the hydraulic pump is critical. Therefore, there is a need for a hydraulic system in which the torque or horsepower of a hydraulic pump can be controlled without the need of mechanical pressure compensation devices.

SUMMARY

An aspect of the present disclosure relates to a fluid device system having a fluid pump, an electric motor in engagement with the fluid pump and a controller in electrical communication with the electric motor. The controller including a lookup table having performance characteristics of the fluid pump and the electric motor.

Another aspect of the present disclosure relates to a fluid device system including a fluid pump, an electric motor in engagement with the fluid pump, and a controller. The electric motor is adapted for rotation in response to an electric signal. The controller is adapted to communicate the electric signal to the electric motor. The controller includes a lookup table having a plurality of performance data related to the fluid pump and the electric motor. The performance data from the lookup table is used by the controller to set aspects of the electrical signal communicated to the electric motor in order to achieve a desired attribute of the fluid pump.

Another aspect of the present disclosure relates to a fluid device system having a rotary fluid device. The rotary fluid device includes a housing having a main body with a first end portion and an opposite second end portion. The first end portion defines a first chamber and the second end portion defines a second chamber. A fixed displacement pumping assembly is disposed in the first chamber of the first end portion. An electric motor is disposed in the second chamber of the second end portion. The electric motor includes a shaft that is coupled to the pumping assembly. The fluid device system further includes a plurality of sensors that is adapted to sense operating parameters of the rotary fluid device and a controller. The controller is in electrical communication with the electric motor of the rotary fluid device and the plurality of sensors. The controller includes a microprocessor and a storage media. The storage media is in communication with the microprocessor and includes at least one lookup table that includes performance characteristics of the rotary fluid device. The lookup table is used by the controller to achieve a desired attribute of the rotary fluid device.

Another aspect of the present disclosure relates to method for controlling a rotary fluid device. The method includes receiving at least one operating parameter of a rotary fluid device. The rotary fluid device includes an electric motor coupled to a fluid pump. The method further includes determining a voltage, phase current, phase angle, or combinations thereof to be supplied to the electric motor to generally achieve a desired attribute of the rotary fluid device. The determination is based on the sensed operating parameter of the rotary fluid device and a lookup table that includes a plurality of performance data for the rotary fluid device. The method further includes outputting the voltage, phase current, phase angle or combinations thereof to the electric motor.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
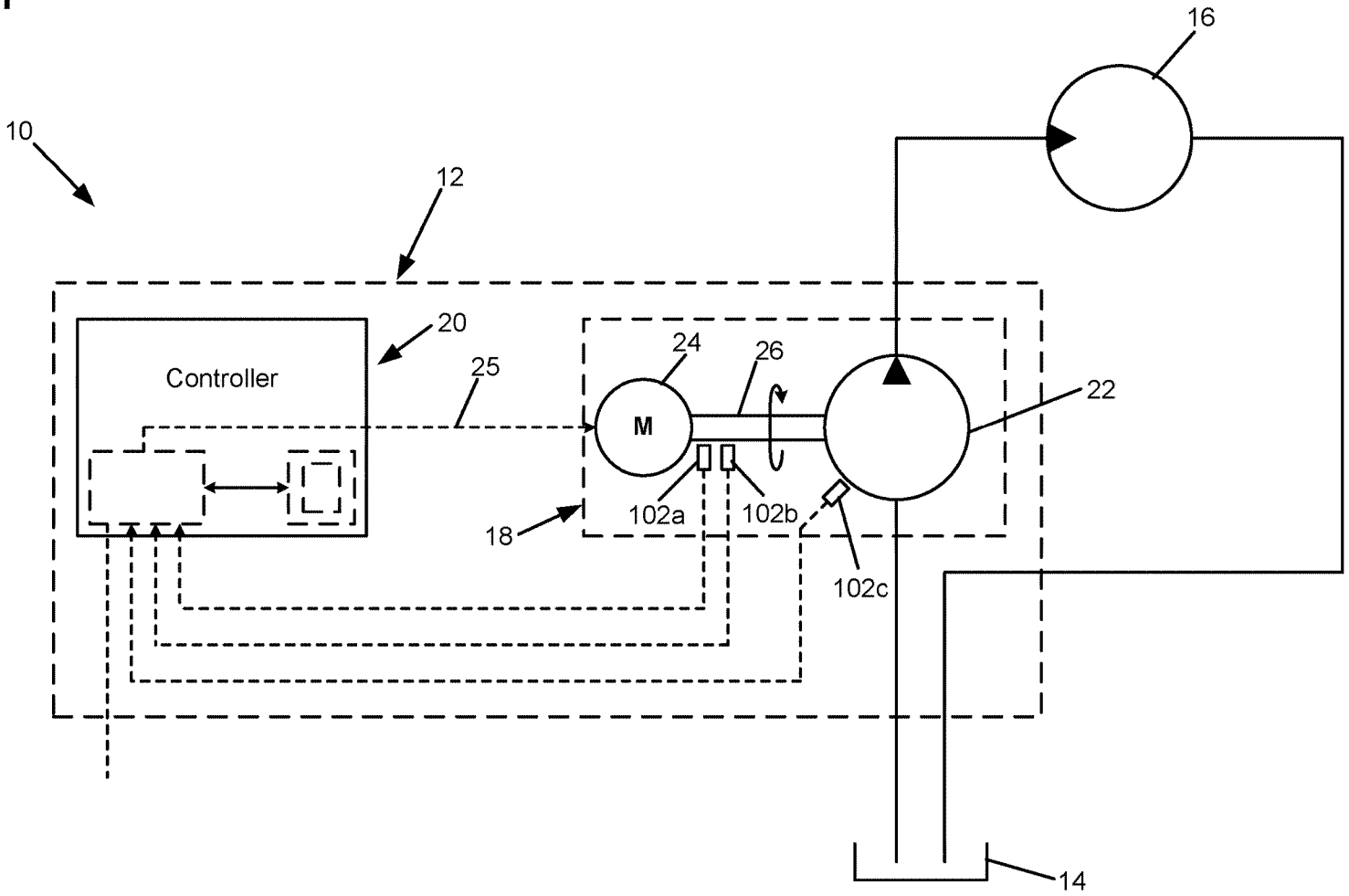
FIG. 1 is a schematic representation of a hydraulic system having a fluid device system having exemplary features of aspects in accordance with the principles of the present disclosure.

Referring now to FIG. 1, a schematic representation of a simplified exemplary hydraulic system, generally designated 10, is shown. The hydraulic system 10 includes a fluid device system, generally designated 12, in fluid communication with a fluid reservoir 14 and an actuator 16 (e.g., motor, cylinder, etc.). The fluid device system 12 includes a rotary fluid device, generally designated 18, and a controller, generally designated 20.

The rotary fluid device 18 includes a fluid pump 22 and an electric motor 24. The fluid pump 22 is a fixed displacement type pump that is in engagement with or coupled to the electric motor 24.

In the depicted embodiment of FIG. 1, the fluid pump 22 is in fluid communication with the fluid reservoir 14 and the actuator 16. While the fluid pump 22 is shown in direct fluid communication with the fluid reservoir 14 and the actuator 16, it will be understood that the scope of the present disclosure is not limited to the fluid pump 22 being in direct fluid communication with the fluid reservoir 14 and the actuator 16 as any number of valves or other fluid components could be disposed between the fluid pump 22 and the fluid reservoir 14 and/or the actuator 16.

In the subject embodiment, the electric motor 24 is in electrical communication with the controller 20. As will be described in greater detail subsequently, the controller 20 outputs an electrical signal 25 to the electric motor 24. In response to the electrical signal 25, a shaft 26 of the electric motor 24 rotates. As the fluid pump 22 is a fixed displacement pump and as the fluid pump 22 is in engagement with the shaft 26 of the electric motor 24, the rotation of the shaft 26 causes the fluid pump 22 to transfer fluid from the fluid reservoir 14 to the actuator 16.

Figure 2:
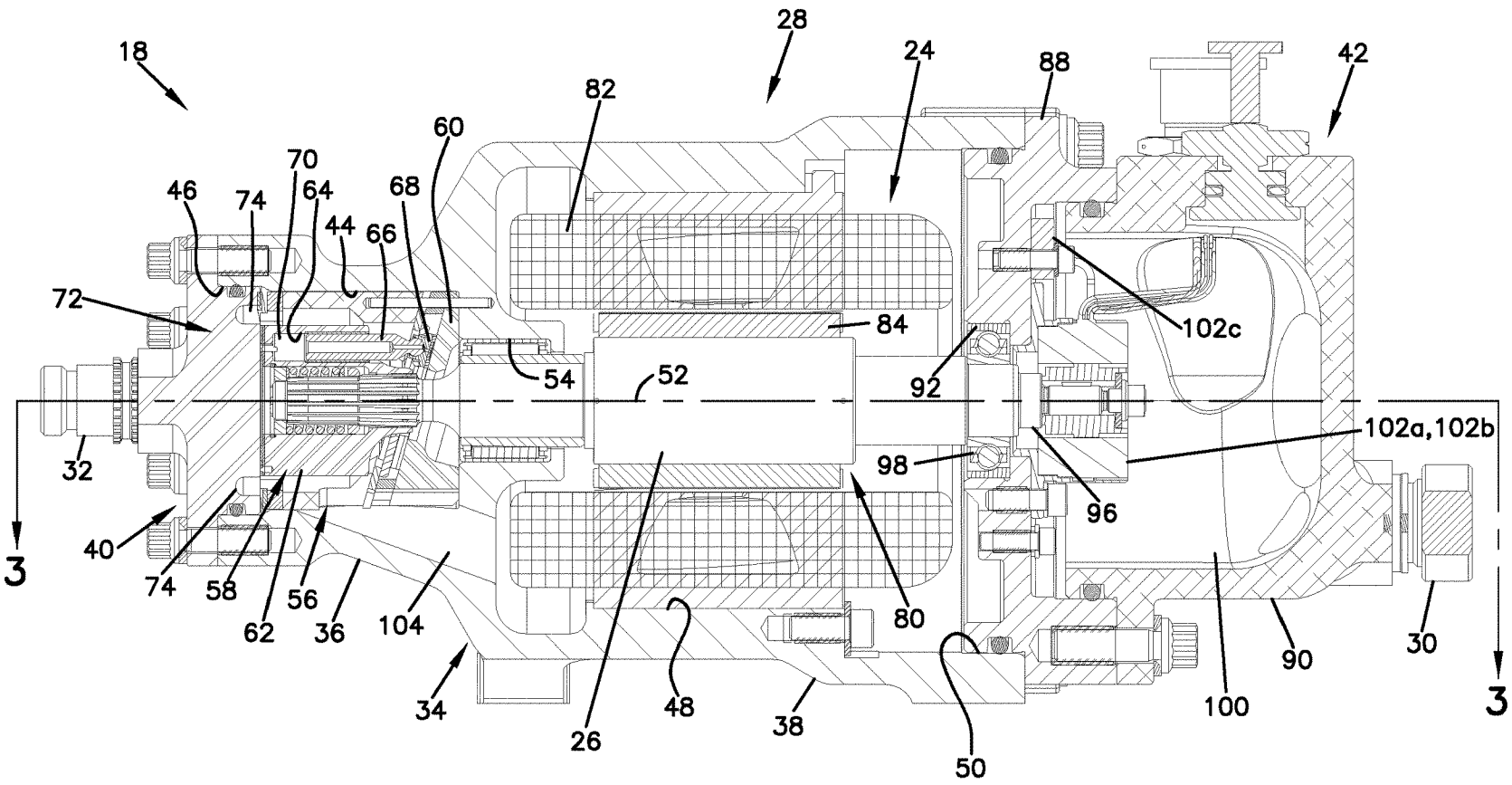
FIG. 2 is a cross-sectional view of a rotary fluid device suitable for use with the fluid device system of FIG. 1.

Referring now to FIG. 2, the rotary fluid device 18 is shown. The rotary fluid device 18 includes a housing, generally designated 28. The housing 28 includes a fluid inlet 30 and a fluid outlet 32. The housing 28 further includes a main body, generally designated 34, which includes a first end portion 36 and an opposite second end portion 38, a first end assembly, generally designated 40, which is adapted for engagement with the first end portion 36 of the main body 34, and a second end assembly, generally designated 42, which is adapted for engagement with the second end portion 38.

The first end portion 36 of the main body 34 defines a first chamber 44 having a first opening 46 while the second end portion 38 defines a second chamber 48 having a second opening 50. In the subject embodiment, the first and second openings 46, 50 are oppositely disposed along a longitudinal axis 52 of the main body 34. A passage 54 through the main body 34 connects the first chamber 44 to the second chamber 48.

In the subject embodiment, the first chamber 44 is adapted to receive the fluid pump 22 through the first opening 46 while the second chamber 48 is adapted to receive the electric motor 24 through the second opening 50. The shaft 26 of the electric motor 24 extends through the passage 54 and is engaged with the fluid pump 22.

A pumping assembly, generally designated 56, is disposed in the first chamber 44 of the main body 34. While the pumping assembly 56 is shown as an axial piston assembly, it will be understood that the scope of the present disclosure is not limited to the pumping assembly 56 being an axial piston assembly as the pumping assembly 56 could be a vane assembly, gerotor assembly, cam lobe assembly, etc. In the subject embodiment, the pumping assembly 56 includes a barrel assembly 58 and an angle block 60.

The barrel assembly 58 includes a cylinder barrel 62 defining an inner bore. In the subject embodiment, the inner bore of the cylinder barrel 62 includes a plurality of internal teeth that are adapted for engagement with the shaft 26.

The cylinder barrel 62 further defines a plurality of axially oriented cylinder bores 64. Disposed within each cylinder bore 64 is an axially reciprocal piston 66, which includes a generally spherical head that is pivotally received by a slipper member 68. The slipper members 68 slide along an inclined surface of the stationary angle block 60.

The cylinder bores 64 and the pistons 66 cooperatively define a plurality of volume chambers 70. In response to rotation of the shaft 26, the cylinder barrel 62 rotates about a rotating axis causing the plurality of volume chambers 70 to expand and contract. In the subject embodiment, the rotating axis is generally aligned with the longitudinal axis 52. During rotation of the cylinder barrel 62, fluid from a fluid source (e.g., the fluid reservoir 14) is drawn into the expanding volume chambers 70 while fluid from the contracting volume chambers 70 is expelled to a fluid destination (e.g., the actuator 16).

The first end assembly 40 is engaged with the first end portion 36 of the main body 34. The first end assembly 40 includes a valving portion 72 having an inlet passage 74 and an outlet passage 76 (shown in FIG. 3). In the subject embodiment, the inlet and outlet passages 74, 76 are arcuately shaped fluid passages. The inlet and outlet passages 74, 76 are adapted for commutating fluid communication with the volume chambers 70 of the barrel assembly 58. The expanding volume chambers 70 are in fluid communication with the inlet passage 74 while the contracting volume chambers 70 are in fluid communication with the outlet passage 76. The inlet passage 74 is in fluid communication with the fluid inlet 30 while the outlet passage 76 is in fluid communication with the fluid outlet 32. In the subject embodiment, the fluid outlet 32 is defined by the first end assembly 40.

The electric motor 24 is disposed in the second chamber 48 of the main body 34. The electric motor 24 is a 3-phase brushless DC motor. It will be understood, however, that the scope of the present disclosure is not limited to the electric motor 24 being a 3-phase brushless DC motor. The electric motor 24 includes a rotor 80 and a stator 82.

The rotor 80 includes permanent magnets 84 engaged with the shaft 26. In one embodiment, the permanent magnets 86 are keyed to the shaft 26 so that the permanent magnets 86 rotate with the shaft 26.

The stator 82 is engaged with the second end portion 38 of the main body 34. The stator 82 includes a plurality of coils that create an electromagnetic field when current passes through the coils. By energizing the coils of the stator 82, the permanent magnets 86 rotate causing the shaft 26 to rotate as well.

The second end assembly 42 is engaged with the second end portion 38 of the main body 34. In the subject embodiment, the second end assembly 42 includes a plate assembly 88 and a cover assembly 90.

The plate assembly 88 is engaged with the second opening 50 of the second end portion 38 of the main body 34. The plate assembly 88 defines a central passage 92 and a plurality of flow passages 94 (shown in FIG. 3). The central passage 92 is adapted to receive an end portion 96 of the shaft 26. In the subject embodiment, a conventional bearing assembly 98 is engaged in the central passage 92 such that an inner race of the bearing assembly 98 is in tight-fit engagement with the shaft 26 while an outer race of the bearing assembly 98 is in tight-fit engagement with the central passage 92.

The cover assembly 90 defines the fluid inlet 30 for the rotary fluid device 18. In the subject embodiment, the cover assembly 90 and the plate assembly cooperatively define a third chamber 100 of the rotary fluid device 18.

A plurality of sensors 102 is disposed in the third chamber 100. The plurality of sensors 102 includes a speed sensor 102*a*, a position sensor 102*b*, and a fluid temperature sensor 102*c*. In the subject embodiment, a conventional resolver is used for the speed sensor 102*a* and the position sensor 102*b*. The resolver includes a stator portion and a rotor portion. The stator portion includes a plurality of wire windings through which current flows. As the rotor portion rotates, the relative magnitudes of voltages through the wire windings are measured and used to determine speed and position of the rotor portion. In the subject embodiment, the rotor portion is disposed on the end portion 96 of the shaft 26.

The fluid temperature sensor 102*c* measures the temperature of the fluid in the rotary fluid device 18. In the subject embodiment, the fluid temperature sensor 102*c* is engaged with the plate assembly 88 and disposed adjacent to one of the plurality of flow passages 94. In a preferred embodiment, the fluid temperature sensor 102*c* is a conventional resistance temperature detector (RTD). The RTD includes a resistor that changes resistance value as its temperature changes.

Figure 3:
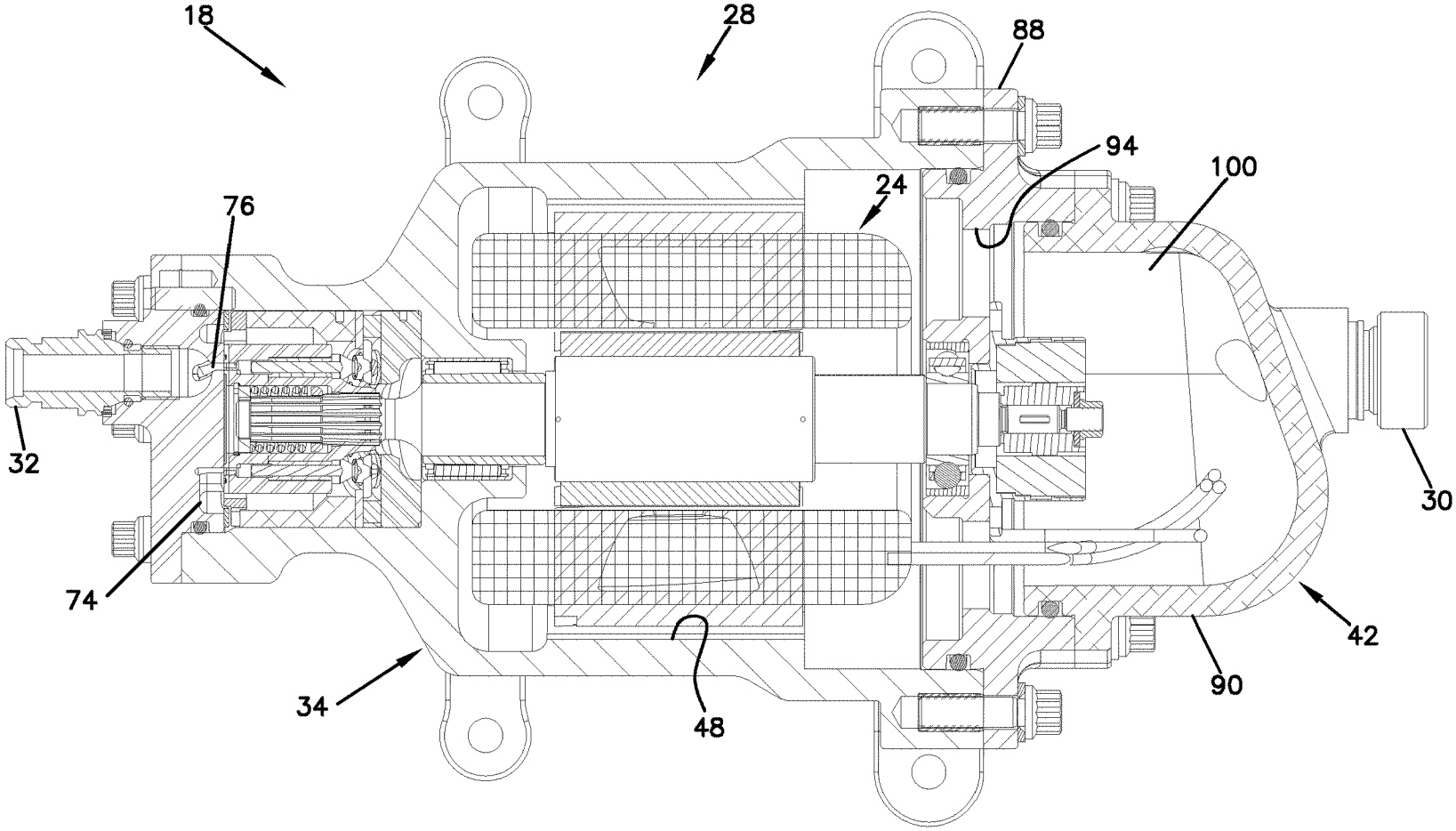
FIG. 3 is a cross-sectional view of the rotary fluid device taken on line 3-3 of FIG. 2.

Referring now to FIGS. 2 and 3, the flow of fluid through the rotary fluid device 18 will be described. As the shaft 26 of the electric motor 24 rotates, fluid enters the fluid inlet 30 of the second end assembly 42. The fluid enters the third chamber 100 and passes through the flow passages 94 in the plate assembly 88. The fluid then enters the second chamber 48 of the main body 34. In the second chamber 48, the fluid is in contact with the electric motor 24. This fluid contact is potentially advantageous as it provides lubrication to the electric motor 24.

The fluid passes from the second chamber 48 to the first chamber 44 through a fluid pathway 104. The fluid pathway 104 is in fluid communication with the inlet passage 74. The fluid then enters the expanding volume chamber 70. As the barrel assembly 58 rotates about the rotating axis, the pistons 66 axially extend and retract from the cylinder bores 64. As the pistons 66 extend, the volume chambers 70 expand thereby drawing fluid from the inlet passage 74 into the expanding volume chambers. As the pistons 66 contract, the volume chambers 70 contract thereby expelling fluid from the contracting volume chambers 70 through the outlet passage 76 and through the fluid outlet 32.

Figure 4:
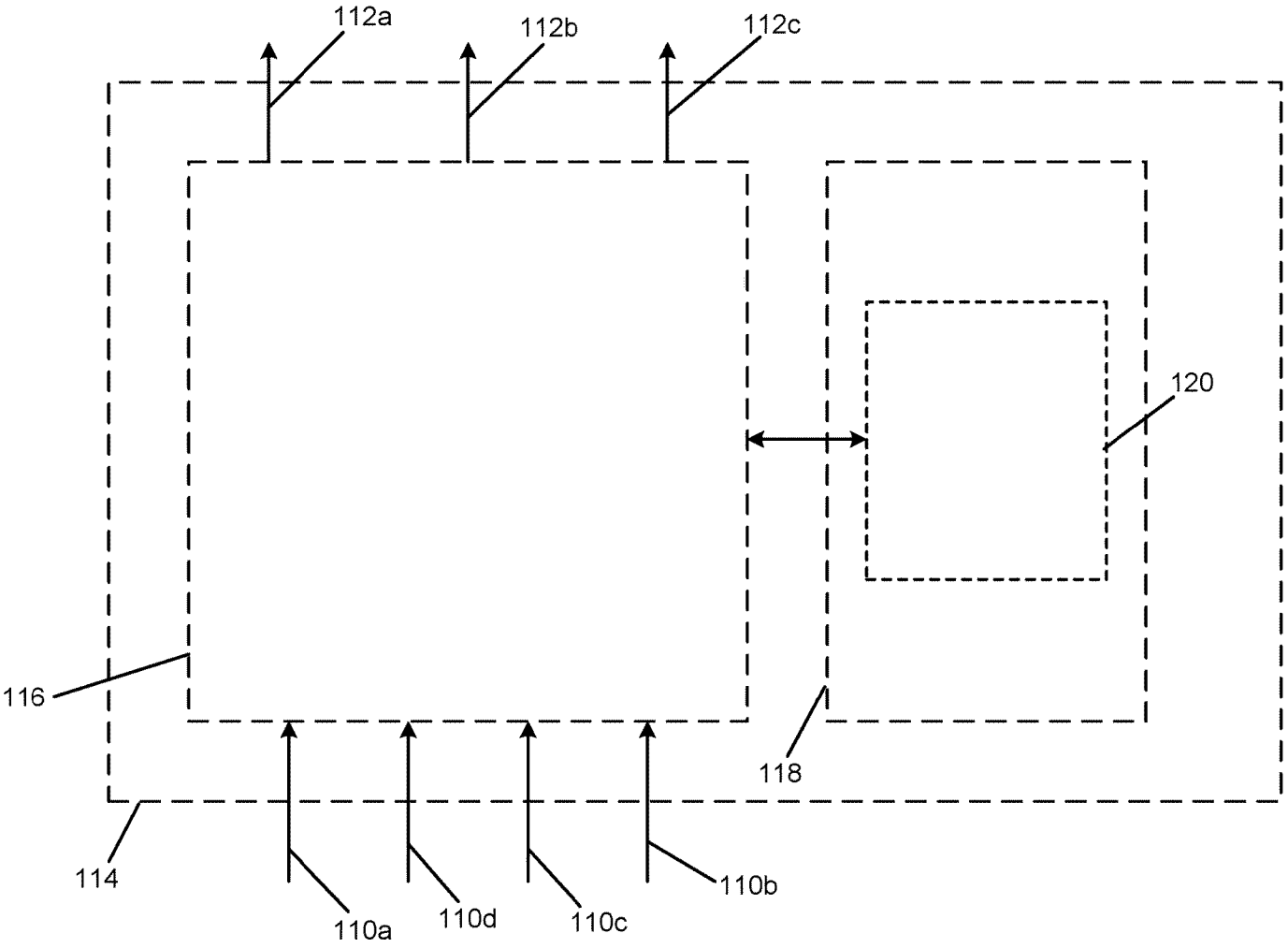
FIG. 4 is a schematic representation of a controller suitable for use with the fluid device system of FIG. 1.

Referring now to FIG. 4, a schematic representation of the controller 20 is shown. The controller 20 supplies an electrical signal 25 to the electric motor 24 in order to obtain a desired characteristic (e.g., constant horsepower, pressure compensation, etc.) from the rotary fluid device 18. The controller 20 uses a control algorithm and predefined performance data for the electric motor 24 and the fluid pump 22 to control or regulate the rotary fluid device 18. In one embodiment, the control algorithm is a field oriented control and space vector pulse width modulation control algorithm. Through the use of the predefined performance data, the rotary fluid device 18 can be controlled to have constant horsepower characteristics or pressure compensation characteristics without the use of typical mechanical pressure compensation devices (e.g., yokes, springs, valves, etc.).

In the subject embodiment, the controller 20 converts a direct current voltage input to an alternating phase current output, which is supplied to the electric motor 24 for driving the pumping assembly 56. The controller 20 includes a plurality of inputs 110. In the subject embodiment, and by way of example only, the plurality of inputs 110 include a voltage input 110*a*, a shaft speed input 110*b*, a shaft position input 110*c* and a fluid temperature input 110*d*.

Voltage is supplied to the controller 20 through the voltage inlet 110*a* by a power supply. In the subject embodiment, the power supply is a DC power supply. The speed sensor 102*a* and the position sensor 102*b*, which are disposed in the third chamber 100 of the rotary fluid device 18, provide information to the controller 20 regarding the speed and position of the shaft 26 through the shaft speed input 110*b* and the shaft position input 110*c*. The fluid temperature sensor 102*c*, which is disposed in the third chamber 100 of the rotary fluid device 18, provides information to the controller 20 regarding the fluid temperature in the rotary fluid device 18. In one embodiment, the plurality of sensors 102 provides sensed operating parameters of the rotary fluid device 18 to the controller 20 continuously. In another embodiment, the plurality of sensors 102 provides sensed operating conditions to the controller 20 on an intermittent basis. In another embodiment, the plurality of sensors 102 provides sensed operating conditions to the controller 20 when the operating conditions sensed are different than the previously provided operating conditions.

The controller 20 further includes a plurality of outputs 112 including a voltage output 112*a*, a phase current output 112*b* and a phase angle output 112*c*. In the subject embodiment, each of the plurality of outputs 112 is in electrical communication with the electric motor 24.

The controller 20 further includes a circuit 114 having a microprocessor 116 and a storage media 118. In the subject embodiment, the microprocessor 116 is a field programmable gate array (FPGA). The FPGA 116 is a semiconductor device having programmable logic components, such as logic gates (e.g., AND, OR, NOT, XOR, etc.) or more complex combinational functions (e.g., decoders, mathematical functions, etc.), and programmable interconnects, which allow the logic blocks to be interconnected. In the subject embodiment, the FPGA 116 is programmed to provide voltage and current to the electric motor 24 of the rotary fluid device 18 such that the rotary fluid device 18 responds in accordance with desired performance characteristics (e.g., constant horsepower, pressure compensation, constant speed, etc.). In one embodiment, the FPGA 116 is a commercially available product from Actel Corporation, which is sold under product identification number A42MX24.

The storage media 118 can be volatile memory (e.g., RAM), non-volatile memory (e.g., ROM, flash memory, etc.), or a combination of the two. In the subject embodiment, the storage media 118 is non-volatile memory. The storage media 118 includes program code for the FPGA 116 and a lookup table 120.

In the subject embodiment, the lookup table 120 includes performance data for the rotary fluid device 18. In one embodiment, and by way of example only, the lookup table 120 includes a relationship between phase current supplied to the electric motor 24 and the speed of the shaft 26 of the rotary fluid device 18. As the lookup table 120 provides performance characteristics of the rotary fluid device 18, the lookup table 120 accounts for performance losses in the pumping assembly 56 and the electric motor 24. These performance losses include but are not limited to leakage. In the subject embodiment, the lookup table 120 further provides a relationship between the phase angle between voltage and current supplied to the electric motor 24 and the torque output of the electric motor 24.

In the subject embodiment, the lookup table 120 is a multi-dimensional table. In the subject embodiment, and by way of example only, the variables of the lookup table 120 include phase current supplied to the electric motor 24, phase angle between voltage and current supplied to the electric motor 24, the speed of the shaft 26 of the rotary fluid device 18, torque output of the electric motor 24, and fluid temperature. The lookup table 120 includes temperature variables to account for changes in the relationship between phase current and shaft speed and phase angle and torque due to fluctuations in fluid temperature.

Figure 5:
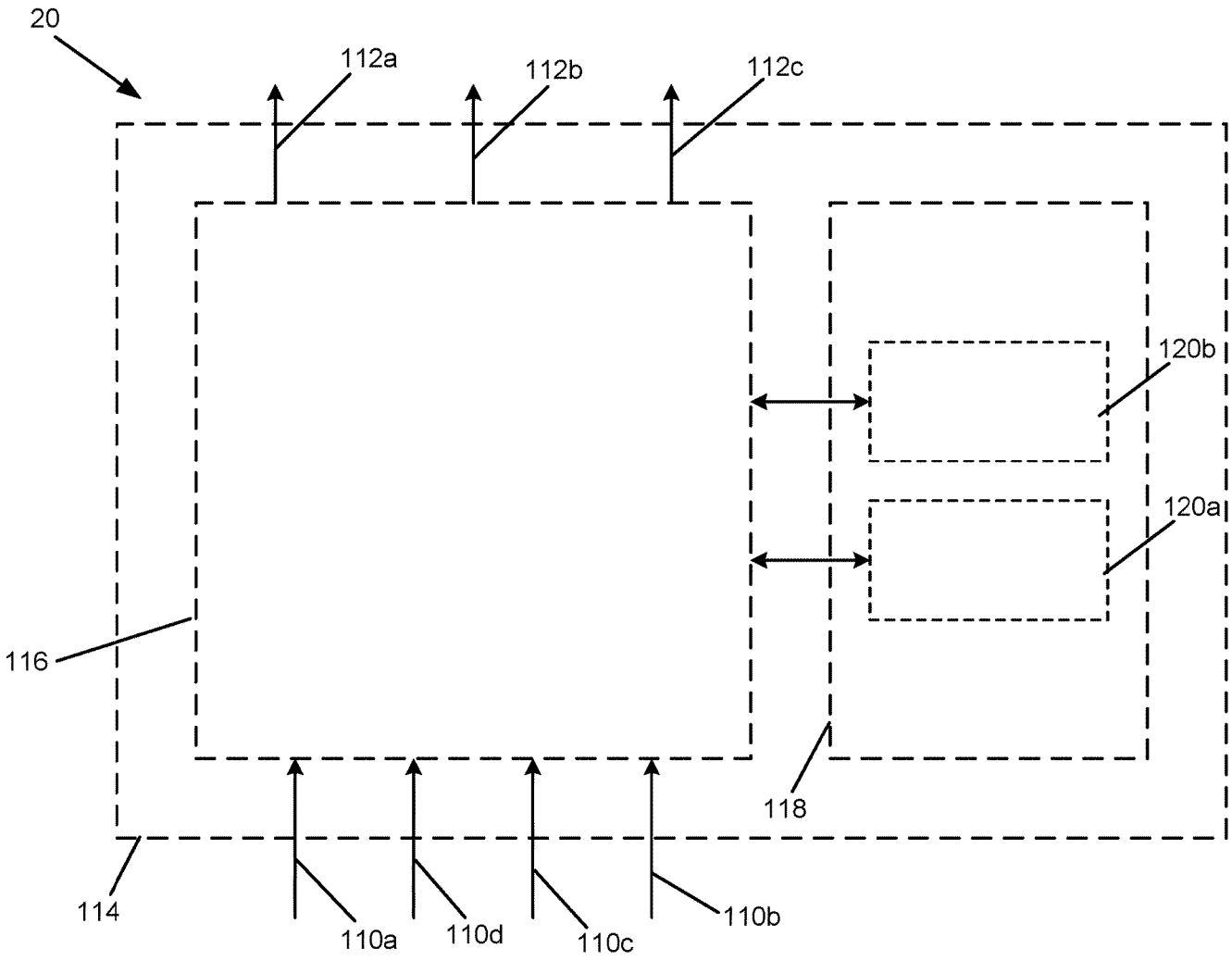
FIG. 5 is an alternate schematic representation of a controller suitable for use with the fluid device system of FIG. 1.

Referring now to FIG. 5, an alternate schematic representation of the controller 20 is shown. In this alternate embodiment, the storage media 118 includes a first lookup table 120*a* and a second lookup table 120*b*. Each of the first and second lookup tables 120*a*, 120*b* provides performance data for the rotary fluid device 18. In one embodiment, and by way of example only, the first lookup table 120*a* provides a relationship between phase current supplied to the electric motor 24 and the speed of the shaft 26 of the rotary fluid device 18 while the second lookup table 120*b* provides a relationship between the phase angle between voltage and current supplied to the electric motor 24 and the torque output of the electric motor 24.

Referring now to FIGS. 1 and 4, the operation of the fluid device system 12 will be described. Voltage is supplied to the circuit 114 of the controller 20 from a power source (e.g., battery, generator, etc.). With the circuit 114 in a powered state, the FPGA 116 receives sensed operating parameters of the rotary fluid device 18 from the plurality of sensors 102.

The sensed operating parameters are received through the plurality of inputs 110. The FPGA 116 uses these sensed operating parameters and the lookup table 120 to determine parameters (e.g., voltage, phase current, phase angle, etc.) of the electrical signal 25 that correlate to the desired attribute (e.g., constant horsepower, constant torque, etc.) of the rotary fluid device. The controller 20 outputs the electrical single 25 having the determined parameters to the electric motor 24.

In one example, the controller 20 can be used to maintain a generally constant horsepower from the pumping assembly 56 by controlling the voltage and current supplied to the electric motor 24 in response to information provided in the lookup table 120. For example, the horsepower (i.e., $HP_{motor\text{-}in}$) supplied to the electric motor from the controller 20 can be computed by multiplying the voltage from the controller 20 times the current from the controller 20. The horsepower out (i.e., $HP_{motor\text{-}out}$) of the electric motor 24 can be computed by multiplying the horsepower (i.e., $HP_{motor\text{-}in}$) supplied to the electric motor 24 times the efficiency of the electric motor 24. In the subject embodiment, the horsepower out (i.e., $HP_{motor\text{-}out}$) of the electric motor 24 is generally equal to the horsepower (i.e., $HP_{pump\text{-}in}$) supplied to the pumping assembly 56. The horsepower out (i.e., $HP_{pump\text{-}out}$) of the pumping assembly 56 can be computed by multiplying the horsepower (i.e., $HP_{pump\text{-}in}$) supplied to the pumping assembly 56 times the efficiency of the pumping assembly 56. Therefore, in the subject example, the horsepower (i.e., $HP_{out}$) out of the rotary fluid device 18 is equal to the voltage supplied by the controller 20 times the current supplied by the controller 20 times the efficiency of the rotary fluid device 18 (i.e., efficiency of the electric motor 24 times the efficiency of the pumping assembly 56). In one embodiment, the controller 20 receives the efficiency of the rotary fluid device 18 from the lookup table 120 in response to information from at least one of the plurality of inputs 110 of the controller 20. In another embodiment, the controller computes the efficiency of the rotary fluid device 18 from the information provided by the lookup table 120 based on information from at least one of the plurality of inputs 110 of the controller 20. Based on this efficiency, the controller 20 can modify, adjust or regulate the voltage, current and phase angle accordingly to maintain a generally constant horsepower from the rotary fluid device 18.

In another example, the controller 20 can be used as a pressure compensator for the pumping assembly 56 by controlling the voltage and current supplied to the electric motor 24 in response to information provided in the lookup table 120. In the subject embodiment, the controller 20 regulates the outlet pressure from the pumping assembly 56 by regulating the speed of the electric motor 24, which controls the flow output of the rotary fluid device 18.

Knowing the speed of the shaft 26 of the rotary fluid device 18 and the current supplied to the electric motor 24, the controller 20 can determine the torque output of the rotary fluid device 18 by using the lookup table 120. As torque is a function of pressure and displacement of the rotary fluid device 18 and as the displacement of the rotary fluid device 18 is fixed, the controller 20 can determine the pressure of the rotary fluid device 18 based on this torque determination.

In one embodiment, the controller 20 includes a predefined pressure and/or torque upper limit. If the controller 20 determines that the pressure or torque output of the rotary fluid device 18 is exceeding this limit, the controller 20 can reduce the pressure or torque by reducing the speed of the electric motor 24. As the speed of the electric motor 24 decreases, the pressure output from the rotary fluid device 18 also decreases. When the pressure or torque of the rotary fluid device 18 is below the limit, the controller 20 can regulate the speed of the electric motor 24 to maintain the pressure of the rotary fluid device 18.

In another embodiment, the controller 20 includes the predefined pressure and/or torque upper limit and a lower speed threshold. In this embodiment, if the speed of the electric motor 24 is decreased to the lower speed threshold and the pressure and/or torque of the rotary fluid device 18 has not decreased below the upper limit, the controller 20 stops supplying current to the electric motor 24. Once the pressure and/or torque of the rotary fluid device 18 falls below the upper limit, the controller 20 will supply current to the electric motor 24.

In the subject embodiment, the lookup table 120 for the FPGA 116 is stored in the storage media 118. The lookup table 120 provides performance characteristics for the rotary fluid device 18 for a desired operation output (e.g., constant horsepower, pressure compensation, constant speed, etc.). In one embodiment, it may be advantageous to control the rotary fluid device 18 as a constant horsepower device while in another embodiment it may be advantageous to control the rotary fluid device 18 as a pressure compensated device. One potential advantage of the fluid device system 12 is that the rotary fluid device 18 can be changed from one desired mode of operation (e.g., constant horsepower) to another desired mode of operation (e.g., pressure compensation) by changing the lookup table 120. In one embodiment, the lookup table 120 can be changed by uploading new lookup table 120 into the storage media 118.

In another embodiment, multiple lookup tables 120 are stored on the storage media 118. A user selects which lookup table 120 is used by the controller 20 based on the desired mode of operation of the rotary fluid device 18. For example, the controller 20 may be in electrical communication with a multi-position switch. With the switch in a first position, a first lookup table 120 having performance characteristics for the rotary fluid device 18 in constant horsepower mode is used by the controller 20. With the switch in a second position, a second lookup table 120 having performance characteristics for the rotary fluid device 18 in pressure compensation mode is used by the controller 20. The switch can be manually or electronically operated.

In another embodiment, the multiple lookup tables 120 are selected based on a sensed parameter of the rotary fluid device 18. For example, in one embodiment, the controller 20 uses the first lookup table 120 if the speed of the shaft 26 of the rotary fluid device 18 is above a certain threshold such as 8,000 rpm while a second lookup table 120 is used if the speed of the shaft 26 of the rotary fluid device 18 is below a certain threshold, such as 8,000 rpm. It will be understood, however, that a single lookup table 120 could incorporate the performance characteristics of the first and second lookup tables 120.

In another embodiment, the multiple lookup tables 120 are selected based on power source to the electric motor 24. For example, if the power being supplied to the electric motor 24 through the controller 24 is from a power source having a limited reserve such as a battery, the controller uses the first lookup table 120 so that the horsepower output of the rotary fluid device 18 is held generally constant in order to conserve energy. If, however, the power being supplied to the electric motor 24 through the controller 24 is from a source having a greater reserve, the controller uses the second lookup table 120.

In another embodiment, the lookup table 120, which includes the performance characteristics of the rotary fluid device 18, can be updated. For example, if the rotary fluid device 18 is replaced or if the rotary fluid device 18 is rebuilt, a new lookup table 120 having the performance characteristics of the replacement or rebuilt rotary fluid device 18 can be uploaded or stored on the storage media 118.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fluid device system comprising:

a rotary fluid pump having a fluid inlet and a fluid outlet;

an electric motor having a shaft coupled to the rotary fluid pump, the electric motor being adapted for rotation in response to a control signal;

a plurality of sensors including at least a motor shaft speed sensor and a motor shaft position sensor;

a controller adapted to receive inputs from the plurality of sensors and to communicate the control signal to the electric motor, the controller including a lookup table having pump performance data accounting for changes in a relationship between at least one of phase current and shaft speed, and phase angle and torque due to performance losses of the rotary fluid pump;

wherein the inputs from the plurality of sensors and the pump performance data from the lookup table are used by the controller to determine an efficiency of the rotary fluid pump, wherein the controller uses the determined rotary fluid pump efficiency to modify the control signal to the motor to regulate an output parameter of the rotary fluid pump.

2. The fluid device of claim 1, wherein performance losses in the rotary fluid pump are due to leakage of the rotary fluid pump.

3. The fluid device of claim 2, wherein the control signal to the electric motor includes at least one of a voltage, a phase current, and a phase angle.

4. The fluid device of claim 3, wherein the pump performance data from the lookup table is used by the controller to achieve at least one output parameter of a generally constant fluid horsepower output and a pressure compensation of the rotary fluid pump.

5. The fluid device of claim 4, wherein the lookup table includes a first lookup table used by the controller to operate the rotary fluid pump in a generally constant fluid horsepower output mode and includes a second lookup table used by the controller to operate the rotary fluid pump in a pressure compensation output mode.

6. The fluid device of claim 5, further including a manual switch in communication with the controller for operating the rotary fluid pump between the generally constant fluid horsepower output mode and the pressure compensation output mode.

7. The fluid device of claim 5, wherein the controller is adapted to automatically switch between the generally constant fluid horsepower output mode and the pressure compensation output mode based on a sensed parameter.

8. The fluid device of claim 7, wherein the sensed parameter of the rotary fluid device is an input received from the motor shaft speed sensor.

9. The fluid device of claim 1, wherein the lookup table includes temperature variables to account for the changes in a relationship between at least one of phase current and shaft speed, and phase angle and torque due to fluctuations in flued temperature.

* * * * *